US006132924A

United States Patent [19]

Patel et al.

[11] Patent Number: 6,132,924

[45] Date of Patent: Oct. 17, 2000

[54] TONER COAGULANT PROCESSES

[75] Inventors: Raj D. Patel, Oakville; Michael A. Hopper, Toronto; Richard P. N. Veregin, Mississauga, all of Canada

[73] Assignee: Xerox Corporation, Stamford, Conn.

[21] Appl. No.: 09/173,405

[22] Filed: Oct. 15, 1998

[51] Int. Cl.[7] ..... G03Q 9/08

[52] U.S. Cl. ..... 430/137

[58] Field of Search ..... 430/137, 109

[56] References Cited

U.S. PATENT DOCUMENTS

| | | | |
|---|---|---|---|
| 4,137,188 | 1/1979 | Uetake et al. | 252/62.1 P |
| 4,286,037 | 8/1981 | Hectors et al. | 430/137 |
| 4,558,108 | 12/1985 | Alexandru et al. | 526/340 |
| 4,797,339 | 1/1989 | Maruyama et al. | 430/109 |
| 4,935,326 | 6/1990 | Creatura et al. | 430/108 |
| 4,937,166 | 6/1990 | Creatura et al. | 430/108 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,585,215 | 12/1996 | Ong et al. | 430/137 |
| 5,650,255 | 7/1997 | Ng et al. | 430/137 |
| 5,650,256 | 7/1997 | Veregin et al. | 430/137 |
| 5,660,965 | 8/1997 | Mychajlowskij et al. | 430/137 |
| 5,766,818 | 6/1998 | Smith et al. | 430/137 |
| 5,994,020 | 11/1999 | Patel et al. | 430/137 |

*Primary Examiner*—Christopher D. Rodee
*Attorney, Agent, or Firm*—E. O. Palazzo

[57] ABSTRACT

A process for the preparation of toner comprising mixing a colorant, a latex, and two coagulants, followed by aggregation and coalescence.

21 Claims, No Drawings

TONER COAGULANT PROCESSES

PENDING APPLICATIONS AND PATENTS

In application U.S. Ser. No. 922,437, now abandoned the disclosure of which is totally incorporated herein by reference, is, for example, a process for the preparation of toner comprising (i) aggregating with a metal complex, or metal ion a colorant dispersion with a latex emulsion and optional additives to form aggregates;

(ii) coalescing or fusing the aggregates; and optionally (iii) isolating, washing, and drying the toner.

Illustrated in U.S. Pat. No. 5,944,650, the disclosure of which is totally incorporated herein by reference are novel surfactants, that is cleavable or hydrolyzable surfactants of the Formulas (I), (II), or (III), and in U.S. Pat. No. 5,766,818, the disclosure of which is totally incorporated herein by reference are toner processes wherein cleavable surfactants are selected, and which surfactants may be selected for the processes of the present invention.

The appropriate components and processes of the above recited copending applications and patents may be selected for the processes of the present invention in embodiments thereof.

BACKGROUND OF THE INVENTION

The present invention is generally directed to toner processes, and more specifically, to chemical processes which involve the aggregation and fusion of latex, colorant, like pigment, or dye, and additive particles into toner particles, and wherein aggregation can be controlled by utilizing two coagulants, such as a polyaluminum chloride, preferably dissolved in an acid, like nitric acid, and an ionic surfactant such as Snail B, that is a benzylalkonium chloride, and wherein there is preferably selected a latex comprised of for example, submicron resin particles preferably in the size range of about 0.1 to about 0.4 micron in volume average diameter, suspended in an aqueous phase of water, nonionic and anionic surfactants to which is added a colorant dispersion comprising for example, preferably submicron colorant particles in the size range of 0.08 to 0.3 micron in volume average diameter, anionic surfactant, or optionally a nonionic surfactant, or mixtures thereof, and wherein the resultant blend is preferably stirred and heated to a temperature below about the resin Tg, resulting aggregates to which optionally is added a second latex, followed by adjusting the pH of the mixture with a base, and heating the mixture to a temperature above about the resin Tg to fuse the aggregates. The two coagulants selected appear to form a complex which results in neutralizing, or passivating the colorant.

More specifically, the present invention is generally directed to the aggregation and coalescence or fusion of latex, colorant, like pigment, dye, or mixtures thereof, in the presence of at least two coagulants, known initiators, and chain transfer agents, and wherein there is generated toner compositions with, for example, a volume average diameter of from about 1 micron to about 25 microns, and preferably from about 2 microns to about 10 microns, and a narrow particle size distribution of, for example, from about 1.10 to about 1.32, the size and size distribution being measured by a Coulter Counter, without the need to resort to conventional pulverization and classification methods, wherein a minimum amount of surfactant may be used, and wherein in embodiments washing of the toner permits the latex cleavable surfactant selected, which is hydrolyzable, or cleavable, to convert to a substantially inert form, or wherein the surfactant is converted to a form, which is easily removed from the toner, to provide a suitable toner triboelectrical charge, and wherein in this embodiment the removal of the surfactant selected is avoided and washing may not be needed, or wherein washing can be substantially reduced or eliminated. In important embodiments, the present invention relates to the use of cleavable nonionic surfactants, and which surfactants can be readily hydrolyzed by, for example, the addition of base to the surfactant in the pH range of from about 8 to about 13 into, or wherein the surfactants can be modified into water soluble components for simple washing thereof and removal from the toner generated. The toners generated can be selected for known electrophotographic imaging and printing processes, including digital color processes.

Toner generated by the processes of the present invention possess a number of advantages as compared to several emulsion/aggregation processes, these advantages including a coalescence time of about 0.5 to about 4 hours and a temperature in the range of 80 to about 90° C. thereby permitting a process reduction time of about 40 to about 50 percent. Additionally, with the invention processes in embodiments toner washing can be reduced by about 60 to about 75 percent and the triboelectric charging values of the toner obtained are substantially constant irrespective of the colorant selected. Furthermore, when the toners generated are roll milled and aged over a period of for example, 2 hours there results stable and negative toner charging with for example, no wrong sign positively charged toner.

The toners generated with the processes of the present invention are especially useful for imaging processes, especially xerographic processes, which usually require high toner transfer efficiency, such as those with a compact machine design without a cleaner or those that are designed to provide high quality colored images with excellent image resolution, acceptable signal-to-noise ratio, and image uniformity.

PRIOR ART

In xerographic systems, especially color systems, small sized toners of preferably from about 2 to about 7 microns are important to the achievement of high image quality for process color applications. It is also important to have a low image pile height to eliminate, or minimize image feel and avoid paper curling after fusing. Paper curling can be particularly pronounced in xerographic color processes primarily because of the presence of relatively high toner coverage as a result of the application of three to four color toners. During the fusing step, moisture escapes from the paper due to high fusing temperatures of from about 120° C to 200° C. In the situation wherein with only one layer of toner is selected, such as in one-color black or highlight color xerographic applications, the amount of moisture driven off during fusing can be reabsorbed by the paper and the resulting print remains relatively flat with minimal paper curl. In process color where toner coverage is high, the relatively thick toner plastic covering on the paper can inhibit the paper from reabsorbing the moisture, and cause substantial paper curling. These and other imaging shortfalls and problems are avoided or minimized with the toners and processes of the present invention.

Also, it is preferable to select certain toner particle sizes, such as from about 2 to about 10 microns, and with a high colorant, especially pigment loading such as from about 4 to about 15 percent by weight of toner, so that the mass of toner necessary for attaining the required optical density and color gamut can be significantly reduced to eliminate or minimize paper curl. Lower toner mass also ensures the achievement of image uniformity. However, higher pigment loadings often adversely affect the charging behavior of toners. For example, the charge levels may be too low for proper toner development or the charge distributions may be too wide and toners of wrong charge polarity may be present. Furthermore, higher pigment loadings may also result in the sensitivity of charging behavior to charges in environmental conditions such as temperature and humidity. Toners prepared in accordance with the processes of the present invention minimize, or avoid these disadvantages.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process results in, it is believed the formation of particles with a wide particle size distribution. Similarly, the aforementioned disadvantages, for example poor particle size distributions, are obtained hence classification is required resulting in low toner yields, are illustrated in other prior art, such as U.S. Pat. No. 4,797,339, wherein there is disclosed a process for the preparation of toners by resin emulsion polymerization, wherein similar to the '127 patent certain polar resins are selected; and U.S. Pat. No. 4,558,108, wherein there is disclosed a process for the preparation of a copolymer of styrene and butadiene by specific suspension polymerization. Other prior art includes U.S. Pat. Nos. 3,674,736; 4,137,188 and 5,066,560.

Emulsion/aggregation/coalescence processes for the preparation of toners are illustrated in a number of Xerox patents, the disclosures of each of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. No. 5,348,832; 5,405,728; 5,366,841; 5,496,676; 5,527,658; 5,585,215; 5,650,255; 5,650,256 and 5,501,935.

The appropriate components and processes of the above Xerox patents can be selected for the processes of the present invention in embodiments thereof.

SUMMARY OF THE INVENTION

It is a feature of the present invention to provide toner processes with many of the advantages illustrated herein.

In another feature of the present invention there are provided simple and economical processes for the preparation of black and colored toner compositions with excellent colorant dispersions, thus enabling the achievement of excellent color print quality.

In another feature of the present invention there is provided a process of preparing toner particles which evidence similar charging behavior despite differential pigment chemistry.

In yet another feature of the present invention there is provided a process of preparing toner particles which exhibit similar charging behavior with different latexes and dissimilar colorants.

Another feature of the present invention resides in a process of preparing different toner size particles with two coagulants, and wherein minimum amounts of ionic surfactant may be selected.

Additionally another feature of the present invention resides in a process of providing a process capable of delivering differing toner morphology particles such as spherical.

Another feature of the present invention relates to a process of preparing toners particles in less than about half the process time when compared to when using poly aluminum chloride alone.

In another feature of the present invention there are provided processes capable of generating acceptable stable toner triboelectrical toner values with minimum toner washings.

In a further feature of the present invention there is provided a process for the preparation of toner compositions, with a volume average diameter of from between about 1 to about 25 microns, and preferably from about 2 to about 10 microns, and a particle size distribution of about 1.10 to about 1.28, and preferably from about 1.15 to about 1.25, each as measured by a Coulter Counter without the need to resort to conventional classifications to narrow the toner particle size distribution.

Moreover, in a further feature of the present invention there is provided a process for the preparation of toner by aggregation and coalescence, or fusion (aggregation/coalescence) of latex, pigment, and additive particles, and wherein there is selected a nonionic surfactant which may be hydrolyzable or is also selected a nonionic surfactant coagulant of ethoxylated phenols of ANTAROX™ or Dowfax and wherein there is selected two coagulants prior to aggregation.

In yet another feature of the present invention there are provided toner compositions with low fusing temperatures of from about 120° C. to about 185° C., and which toner compositions exhibit excellent blocking characteristics at and above about, or equal to about 45° C.

In another feature of the present invention there is provided toner processes capable of providing toners that generate excellent print quality, and high resolution color prints In still a further feature of the present invention there are provided toner compositions which provide high image projection efficiency, such as for example over 75 percent as measured by the Match Scan II spectrophotometer available from Million-Roy.

Aspects of the present invention relate to a process for the preparation of toner comprising mixing a colorant, a latex, and two coagulants, followed by aggregation and coalescence; a process wherein the colorant is a colorant dispersion comprised of (i) of a colorant, water, an ionic surfactant, a nonionic surfactant or mixtures of an ionic surfactant and a nonionic surfactant; the latex is a latex emulsion; and wherein the (ii) colorant dispersion is blended with a latex emulsion comprised of resin, a nonionic surfactant or a hydrolyzable nonionic and an ionic surfactant, and optionally adding a wax dispersion comprised of submicron particles in the size range of about 0.1 to about 0.4 micron dispersed an ionic surfactant of the same charge polarity to that of the ionic surfactant in the colorant dispersion or latex emulsion;

(iii) adding to the resulting blend containing the latex and colorant said two coagulants of (a) a polyaluminum halide, and (b) a cationic surfactant of opposite charge polarity to that of the latex and colorant surfactant to thereby initiate flocculation of the resin latex and colorant particles;

(iv) heating the resulting mixture below about, or about equal to the glass transition temperature (Tg) of the latex resin to form toner sized aggregates;

(v) optionally adding a latex comprised of submicron resin particles suspended in an aqueous phase to the formed toner aggregates;

(vi) adjusting with a base the pH of the resulting toner aggregate mixture to about 5 to about 9;

(vii) heating the resulting aggregate suspension of (vi) above about, or about equal to the Tg of the latex resin;

(viii) retaining the mixture (vii) temperature in the range of from about 70 to about 95° C. to enable the fusion or coalescence of the toner aggregates, wherein the toner particle size is about 2 about 25 microns;

(ix) optionally washing the resulting toner slurry; and (x) isolating the toner; a process wherein the two coagulants are comprised of a first coagulant of polyaluminum hydroxy halide and a second coagulant of a cationic surfactant; a process wherein the polyaluminum hydroxy halide is a polyaluminum hydroxy chloride complex; a process wherein the cationic surfactant is a benzalkonium chloride; a process wherein the polyaluminum hydroxy halide is selected in an amount of from about 0.05 parts per hundred (pph) to about 0.5 pph by weight of latex resin and colorant, and wherein the latex resin and colorant amount totals about 100 percent, and the cationic surfactant is selected in an amount of from about 0.05 pph to about 0.6 pph by weight of latex resin and colorant, and wherein the latex resin and colorant amount totals about 100 percent; a process wherein the base is selected from the group consisting of sodium hydroxide, potassium hydroxide, and ammonium hydroxide; a process wherein there is optionally added to the formed toner aggregates a second latex in the amount of about 10 to about 25 percent by weight of the initial latex to form a shell on the first latex; a process wherein the added latex comprises the same resin composition and molecular properties as the initial latex used in the blending step or a different composition and properties to that of the initial latex; aprocess wherein said aggregation is accomplished by heating at a temperature of below about the glass transition temperature of the polymer contained in the latex; a process wherein the coalescence is accomplished by heating at a temperature of above about the glass transition temperature of the polymer contained in the latex; a process wherein the aggregation temperature is from about 40 to about 55° C.; a process wherein the coalescence temperature is from about 75 to about 90° C., and preferably about 85° C.; a process wherein there is added to the aggregate mixture prior to coalescence a base component; a process wherein the base is an alkali metal hydroxide; a process wherein the hydroxide is sodium hydroxide; a process wherein the pH of the mixture resulting after blending is increased from about 2.0 to about 2.6 to about 5.5 to about 6.5, and wherein the base functions primarily as a stabilizer for the aggregates during said coalescence; a process wherein the amount of base selected is from about 10 to about 14 weight percent; a process wherein the amount of metal hydroxide selected is from about 11 to about 14 weight percent; a process wherein the latex emulsion contains resin and a surfactant, and wherein the surfactant is of the Formulas (I) or (II), or optionally mixtures thereof (I)

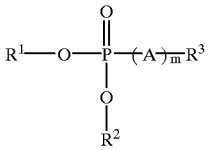

(II)

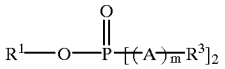

wherein $R^1$ is a hydrophobic aliphatic, or hydrophobic aromatic group; $R^2$ is selected from the group consisting of hydrogen, alkyl, aryl, alkylaryl, and alkylarylalkyl; $R^3$ is hydrogen or alkyl; A is a hydrophilic polymer chain, and m represents the number of A segments; a process wherein $R^1$ is a hydrophobic moiety of alkyl or aryl; and wherein m is a number of from about 5 to about 60, or from about 10 to about 50, and there is accomplished a heating below about or equal to about the resin latex glass transition temperature to form aggregates followed by heating above about or equal to about the resin glass transition temperature to coalesce the aggregates; a process wherein the temperature at which the aggregation is accomplished controls the size of the aggregates, and wherein the final toner size is from about 2 to about 15 microns in volume average diameter; a process wherein the aggregation temperature is from about 45° C. to about 55° C., and wherein the coalescence or fusion temperature is from about 85° C. to about 95° C.; a process wherein the colorant is a pigment, and wherein the pigment is in the form of dispersion and contains an ionic surfactant; a process wherein the surfactant utilized in the colorant dispersion is a cationic surfactant, and the ionic surfactant present in the latex mixture is an anionic surfactant; a process wherein the aggregation is accomplished at a temperature of about 15° C. to about 1° C. below the Tg of the latex resin for a duration of from about 0.5 hour to about 3 hours, and wherein the coalescence or fusion of the components of aggregates for the formation of integral toner particles comprised of colorant and resin is accomplished at a temperature of from about 85° C. to about 95° C. for a duration of from about 1 hour to about 5 hours; a process wherein the latex contains a resin, or polymer selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid); a process wherein the latex contains a resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), and poly(butyl acrylate-isoprene); poly(styrene-propyl acrylate), poly(styrene-butyl acrylate), poly(styrene-butadiene-acrylic acid), poly (styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid); and wherein the colorant is a pigment; a process wherein the colorant is carbon black, cyan, yellow, magenta, or mixtures thereof; the toner isolated is from about 2 to about 10 microns in volume average diameter, and the particle size distribution thereof is from about 1.15 to about 1.30, and wherein there is added to the surface of the formed toner metal salts, metal salts of fatty acids, silicas, metal oxides, or mixtures thereof, each in an amount of from about 0.1 to about 10 weight percent of the obtained toner; a process which comprises mixing a resin containing latex, an ionic surfactant and colorant; heating the resulting mixture below about, or equal to about the glass transition temperature of the resin, followed by the addition of a base to stabilize the toner aggregates, thereafter heating the resulting aggregates above about, or about equal to the glass transition temperature of the resin; and isolating, washing and drying the toner; a process wherein the cleavable surfactant is selected from the group consisting of poly(ethylene glycol) methyl p-tert-octylphenyl phosphate, poly(ethylene glycol)-α-methyl ether-ω-methyl p-tert-octylphenyl phosphate, poly(ethylene glycol) methyl decylphenyl phosphate, poly(ethylene glycol)-α-methyl ether-ω-methyl dodecylphenyl phosphate, poly (ethyleneglycol) methyl dodecylphenyl phosphate, bis[poly (ethylene glycol)-α-methyl ether]-ω-p-tert-octylphenyl phosphate, poly(ethylene glycol)-α,ω-methyl p-tert-octylphenyl phosphate, poly(ethylene glycol) ethyl p-tert-octylphenyl phosphate, poly(ethylene glycol)-α-methyl ether-ω-ethyl p-tert-octylphenyl phosphate, poly(ethylene glycol) phenyl p-tert-octylphenyl phosphate, poly(ethylene glycol)-α-methyl ether-ω-phenyl p-tert-octylphenyl phosphate, poly(ethylene glycol) tolyl p-tert-octylphenyl phosphate, poly(ethylene glycol)-α-methyl ether-ω-tolyl p-tert-octylphenyl phosphate, and poly(ethylene oxide-co-propylene oxide) methyl p-tert-octylphenyl phosphate, wherein the polymer chain contains from about 5 to about 50 repeating units or segments; a process for the preparation of toner comprising mixing a colorant, a latex emulsion, a first coagulant of a polyaluminum hydroxy halide and a second coagulant of a cationic surfactant, adding a base, followed by aggregation and coalescence, and wherein the aggregation is accomplished by heating at a temperature of below about the glass transition temperature of polymer contained in the latex, followed by the addition of a base to stabilize the aggregates, and wherein the coalescence is accomplished by heating at a temperature of above about the glass transition temperature of polymer contained in the latex, and subsequently isolating the toner; a process wherein one coagulant is polyaluminum chloride, and the second coagulant is an alkonium benzalkonium chloride, dialkylbenzenealkyl ammonium chloride, alkylbenzyl methyl ammonium chloride or alkylbenzyl dimethyl ammonium bromide; a process for the preparation of toner comprising aggregating and coalescing a colorant, a latex, and two coagulants; a process wherein one of the coagulants is a water soluble salt; a process wherein the metal salt is selected from a group of the chlorides, sulfates, nitrates, and acetates of aluminum, magnesium, zinc, and potassium; a process wherein the salt is aluminum chloride, zinc sulfate, magnesium sulfate, magnesium chloride, potassium-aluminum sulfate, or zinc acetate; toner processes wherein a colorant and latex dispersion are mixed and sheared, followed by adding to the resulting mixture a coagulant mixture comprised of a cationic surfactant and a poly(aluminum hydroxy halide), especially the chloride, followed by heating below about the latex polymer glass transition, Tg, temperature, followed by adjusting the mixture pH with a base, subsequently heating about above the polymer Tg temperature, and then cooling and isolating the toner formed; toner processes comprising (i) preparing, or utilizing an aqueous colorant dispersion, which dispersion is comprised of a colorant and an ionic surfactant or optionally a nonionic surfactant and optionally a mixture of both surfactants in water;

(ii) blending the colorant dispersion with a latex emulsion comprised of resin particles, a nonionic surfactant or a hydrolyzable nonionic surfactant as disclosed in U.S. Pat. No. 5,766,818, the disclosure of which is totally incorporated herein by reference, and an ionic surfactant and thereafter adding a wax dispersion preferably comprised of submicron wax particles dispersed an ionic surfactant of similar charge polarity to that of the ionic surfactant in the colorant dispersion or in the latex emulsion;

(iii) adding to the blend of the latex and colorant particles two coagulants of polyaluminum chloride dissolved in an acid, such as nitric acid and an ionic surfactant, such as SANIZOL B™, of opposite charge polarity to that of the latex and colorant ionic surfactant to initiate flocculation of latex and pigment particles, (iv) heating the resulting mixture below the glass transition temperature (Tg) of the latex resin to form toner sized aggregates;

(v) optionally adding a known quantity of latex to the formed toner aggregates and stirring the reactor contents for about 30 minutes at a temperature below the resin Tg, (vi) adjusting the pH of the toner aggregates from about 2 to about 6 with a base such as sodium hydroxide, (vii) heating the resulting aggregate suspension of (vi) above about the Tg of the latex resin in the temperature; and (viii) retaining the mixture (vii) temperature in the range of from about 70 to about 95° C., for a period of 0.5 to 6 hours to allow the fusion or coalescence of the toner aggregates, wherein the toner particle size and the particle size distribution is retained, (ix) washing the toner slurry, preferably twice at a pH 11, followed by 2 water washes, isolating and (x) drying the toner obtained; toner processes wherein one of the surfactant selected for the latex, is a cleavable nonionic surfactant as illustrated in U.S. Pat. No.

5,766,818 which surfactant can be, represented by on of the Formulas (I) or (II), or mixtures thereof as illustrated in this patent, wherein $R^1$ is a hydrophobic moiety selected from, for example, the group consisting of alkyl, aryl, and their substituted derivatives such as those containing a halogen atom such as fluorine, chlorine or bromine, and wherein the alkyl group contains, for example, from about 4 to about 60, and preferably from about 6 to about 30 carbon atoms, and the aryl group contains, for example, from about 6 to about 60, and preferably from about 10 to about 30 carbon atoms; $R^2$ may be the same as $R^1$ or different, and can be selected from the group consisting of alkyl, aryl, and their substituted derivatives; $R^3$ is hydrogen or alkyl of from, for example, about 1 to about 10, and preferably 1 to about 3 carbon atoms; A is a hydrophilic polymer chain selected, for example, from the group consisting of polyoxyalkylene, poly(vinyl alcohols), poly(saccharides) and the like, and preferably is a polyoxyalkylene derived from the same or different alkylene oxides with from about 2 to about 4 carbon atoms; and m is the number of repeating units of the hydrophilic polymer chain, and can be a number of, for example, from about 2 to about 500, and preferably from about 5 to about 100, specific examples thereof being poly(ethylene glycol) methyl p-tert-octylphenyl phosphate, poly(ethylene glycol)-α-methyl ether-ω-methyl p-tert-octylphenyl phosphate, poly(ethylene glycol) methyl decylphenyl phosphate, poly(ethylene glycol)-α-methyl ether-ω-methyl dodecylphenyl phosphate, poly(ethyleneglycol) methyl dodecylphenyl phosphate, bis[poly(ethylene glycol)-α-methyl ether]-ω-p-tert-octylphenyl phosphate, poly(ethylene glycol)-α,ω-methyl p-tert-octylphenyl phosphate, poly (ethylene glycol) ethyl p-tert-octylphenyl phosphate, poly(ethylene glycol)-α-methyl ether-ω-ethyl p-tert-octylphenyl phosphate, poly(ethylene glycol) phenyl p-tert-octylphenyl phosphate, poly(ethylene glycol)-α-methyl ether-ω-phenyl p-tert-octylphenyl phosphate, poly(ethylene glycol) tolyl p-tert-octylphenyl phosphate, poly(ethylene glycol)-α-methyl ether-ω-tolyl p-tert-octylpheny) phosphate, and poly(ethylene oxide-co-propylene oxide) methyl p-tert-octylphenyl phosphate, and preferably wherein the polymer chain contains from about 5 to about 50 repeating units or segments; processes for the preparation of toner particles resulting in excellent print quality, and document appearance, passivated toner triboelectrical properties and wide processing latitude, wherein there is selected a latex preferably comprised of submicron resin particles which are in the size range of about 0.05 to about 0.5 micron and preferably in the size range of about 0.7 to about 0.35 micron, suspended in an aqueous water phase of nonionic and anionic surfactants which are preferably selected in an amount of about 0.5 to about 5 percent, and more preferably about 0.7 to about 2 percent by weight of solids, to which is added a colorant dispersion comprising submicron, for example less than, or equal to about 0.5 micron, colorant particles, anionic or a nonionic surfactant which is in the range amount of about 0.5 to about 10.0 percent and preferably about 0.6 to about 5 percent by weight of solids, which when blended together result in a mixture with a pH in the range of about 2 to about 2.6 to which polyaluminum chloride (PAC) solution containing nitric acid is added slowly over a period of about 2 to about 5 minutes, followed by the addition of the cationic coagulant surfactant solution of SANIZOL B™ in water; the amount of PAC is preferably in the range amount of about 0.05 to about 0.5 pph by weight of the solid latex and colorant components, and more preferably in the range of about 0.06 to about 0.3 pph; the amount of the second coagulant, such as SANIZOL B™ is preferably in the range amount of about 0.05 to about 0.6 pph and more preferably in the range of about 0.06 to about 0.5 pph by weight of the solid components in the latex and in the colorant dispersion; further aggregating by stirring and heating from about 5 to 10 degrees below the resin Tg, resulting in toner aggregates of size of about 3 to about 15 microns and preferably about 4 to about 8 microns with a narrow GSD in the range of about 1.14 to about 1.28 and preferably in the range of about 1.17 to about 1.25, and which improved GSD enables the clean transfer of the toner particles in xerographic systems thereby providing enhanced resolution of the fused images; followed by adjusting the pH of the mixture from about 2 to about 2.6 to a pH of about 5.5 to about 7.0 and preferably to about 5.8 to about 6.2 and more preferably to a pH of about 6.1 with the addition of a dilute base solution of 4 weight percent of sodium hydroxide to stabilize the aggregates, further stirring and raising the mixture temperature above the resin Tg, in the range of about 70 to about 95° C., and preferably in the range of about 75 to about 90° C. for a period of about 0.5 to about 5 hours, and preferably from about 0.6 to about 3 hours, to fuse or coalesce the aggregates, and then washing and drying the toner; toner processes wherein a wax dispersion can be added to the latex and colorant mixture, toner processes wherein two coagulants of metal salts and a cationic surfactant can be selected; toner process utilizing latexes containing hydrolyzable surfactants as disclosed in U.S. Pat. No. 5,766,818, which when aggregated in the presence of colorant with the two coagulants of polyaluminum chloride and the cationic surfactant provide toner compositions which upon washing once with deionized water results in a similar charge to that of the toners which have been washed 2 more times or extensively; the general washing procedure is to wash the toner particles containing the original slurry at a pH of 11 followed by filtration and reslurring of the filter cake comprised of toner particles in deionized water whose pH is adjusted to pH 11 with a base such as sodium hydroxide, followed by another wash at pH 11 and two more washes with only water; and processes for the preparation of toner compositions which comprises blending an aqueous colorant dispersion preferably containing a pigment, such as carbon black, phthalocyanine, quinacridone or RHODAMINE B™ type, red, green, orange, brown, and the like, with a latex emulsion derived from the emulsion polymerization of monomers selected, for example, from the group consisting of styrene, butadiene, acrylates, methacrylates, acrylonitrile, acrylic acid, methacrylic acid, and the like, and which latex contains an ionic surfactant such as sodium dodecylbenzene sulfonate and a nonionic surfactant, and which process is accomplished in the presence of a metal salt, or PAC and a second coagulant cationic surfactant, heating the resulting flocculent mixture at a temperature below the resin Tg for an effective length of time of, for example, about 0.5 hour to about 2 hours to form toner sized aggregates; and optionally adding a known amount of delayed latex wherein the latex can be the same as the above initial latex or dissimilar in property, followed by adjusting the pH of the mixture from about 20 to about 60 with a dilute base solution of sodium hydroxide, and subsequently heating the aggregate suspension at a temperature at or below about 90° C. to provide toner particles, isolating the toner product by, for example, filtration, washing and drying in an oven, fluid bed dryer, freeze dryer, or spray dryer.

The particle size of the toner provided by the processes of the present invention in embodiments can be controlled by the temperature at which the aggregation of latex, colorant, such as pigment, and optional additives is conducted. In general, the lower the aggregation temperature, the smaller the aggregate size, and thus the final toner size. For a latex polymer with a glass transition temperature (Tg) of about 55° C. and a reaction mixture with a solids content of about 14 percent by weight, an aggregate size of about 7 microns in volume average diameter is obtained at an aggregation temperature of about 53° C.; the same latex will provide an aggregate size of about 5 microns at a temperature of about 48° C. under similar conditions.

Illustrative examples of specific latex resin, polymer or polymers selected for the process of the present invention include known polymers such as poly(styrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene), poly(styrene-butylacrylate), poly(styrene-butadiene), poly (styrene-isoprene), poly(styrene-butyl methacrylate), poly (styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and the like. The latex polymer, or resin is generally present in the toner compositions of the present invention in various suitable amounts, such as from about 75 weight percent to about 98, or from about 80 to about 95 weight percent of the toner, and the latex size suitable for the processes of the present invention can be, for example, preferably from about 0.05 micron to about 0.5 micron in volume average diameter as measured by the Brookhaven nanosize particle analyzer. Other sizes and effective amounts of latex polymer may be selected in embodiments. The total of all toner components, such as resin and colorant, is about 100 percent, or about 100 parts.

The polymer selected for the process of the present invention is preferably prepared by emulsion polymerization methods, and the monomers utilized in such processes include, for example, styrene, acrylates, methacrylates, butadiene, isoprene, acrylic acid, methacrylic acid, acrylonitrile, and the like. Known chain transfer agents, for example dodecanethiol, from, for example, about 0.1 to about 10 percent, or carbon tetrabromide in effective amounts, such as for example from about 0.1 to about 10 percent, can also be utilized to control the molecular weight properties of the polymer when emulsion polymerization is selected. Other processes of obtaining polymer particles of from, for example, about 0.01 micron to about 2 microns can be selected from polymer microsuspension process, such as disclosed in U.S. Pat. No. 3,674,736, the disclosure of which is totally incorporated herein by reference; polymer solution microsuspension process, such as disclosed in U.S. Pat. No. 5,290,654, the disclosure of which is totally incorporated herein by reference, mechanical grinding processes, or other known processes. Also, the reactant initiators, chain transfer agents, and the like as disclosed in U.S. Ser. No. 922,437, the disclosure of which is totally incorporated herein by reference, can be selected for the processes of the present invention.

Examples of waxes include those as illustrated herein such as polypropylenes and polyethylenes commercially available from Allied Chemical and Petrolite Corporation, wax emulsions available from Michaelman Inc. and the Daniels Products Company, Epolene N-15 commercially available from Eastman Chemical Products, Inc., Viscol 550-P, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 5,000. Example of functionalized waxes include, such as amines, amides for example aqua superslip 6550, Superslip 6530 available from Micro powder Inc, fluorinated waxes for examples Polyfluo 190, Polyfluo 200, Polyfluo 523XF, Aqua Polyfluo 411, Aqua Polysilk 19, Polysilk 14 available from Micro Powders INC, Mixed Fluorinated, amide waxes for example, microspersion 19 also available from Micro powder Inc, imides, esters , quaternary amines, carboxylic acids or acrylic polymer emulsion, for example, Joncryl 74, 89, 130, 537, and 538 all available from SC Johnson Wax, chlorinated polypropylenes and polyethylenes commercially available from Allied Chemical and Petrolite Corporation and SC Johnson wax.

Various known colorants, such as pigments, selected for the processes of the present invention and present in the toner in an effective amount of, for example, from about 1 to about 25 percent by weight of toner, and preferably in an amount of from about 3 to about 10 percent by weight, that can be selected include, for example, carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E. D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, Yellow 180 and Permanent Yellow FGL. Colored magnetites, such as mixtures of MAPICO BLACK™, and cyan components may also be selected as pigments with the process of the present invention, wherein the pigment is in the range of 3 to 15 weight percent of the toner. Dye examples include known suitable dyes, reference the Color Index, and a number of U.S. patents, such as food dyes, and the like.

Colorants, include pigment, dye, mixtures of pigment and dyes, mixtures of pigments, mixtures of dyes, and the like.

Examples of initiators for the latex preparation include water soluble initiators such as ammonium and potassium persulfates in suitable amounts, such as from about 0.1 to about 8 percent and preferably in the range of from about 0.2 to about 5 percent (weight percent). Examples of organic soluble initiators include Vazo peroxides, such as Vazo 64, 2-methyl 2-2'-azobis propanenitrile, Vazo 88, 2-2'-azobis isobutyramide dehydrate in a suitable amount, such as in the range of from about 0.1 to about 8 percent. Examples of chain transfer agents include dodecane thiol, octane thiol, carbon tetrabromide and the like in various suitable amounts, such as in the range amount of from about 0.1 to about 10 percent and preferably in the range of from about 0.2 to about 5 percent by weight of monomer.

Surfactants for the preparation of latexes and colorant dispersions can be anionic or nonionic surfactants, in effective amounts of, for example, from about 0.01 to about 15, or from about 0.01 to about 5 weight percent of the reaction mixture. Anionic surfactants include sodium dodecylsulfate (SDS), sodium dodecylbenzene sulfonate, sodium dodecyinaphthalene sulfate, dialkyl benzenealkyl, sulfates and sulfonates, abitic acid, available from Aldrich, NEOGEN R™, NEOGEN SC™ obtained from Kao, and the like. Examples of cationic surfactants are dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, in effective amounts of, for example, from about 0.01 percent to about 10 percent by weight. Preferably, the molar ratio of the cationic surfactant used for flocculation to the anionic surfactant used in the latex preparation is in the range of from about 0.5 to about 4.

Examples of surfactants, which can be added to the aggregates prior to coalescence is initiated can be selected from anionic surfactants, such as for example sodium dodecylbenzene sulfonate, sodium dodecyinaphthalene sulfate, dialkyl benzenealkyl, sulfates and sulfonates, abitic acid, available from Aldrich, NEOGEN R™, NEOGEN SC™ obtained from Kao, and the like; nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™, and hydrolyzable or cleavable nonionic surfactants of the formulas illustrated herein, such as poly(ethylene glycol) methyl p-tert-octylphenyl phosphate, wherein the surfactant contains, for example, 40 ethylene glycol units, poly (ethylene glycol)-α-methyl ether-ω-methyl p-tert-octylphenyl phosphate (wherein the surfactant contains 17 ethylene glycol units). An effective amount of the anionic or nonionic surfactant utilized in the coalescence to stabilize the aggregate size against further growth with temperature is, for example, from about 0.01 to about 10 percent by weight, and preferably from about 0.5 to about 5 percent by weight of the reaction mixture components.

Examples of the first coagulant are polyaluminum halides, preferably polyaluminum chloride, which is commercially available, and can be prepared by the controlled hydrolysis of aluminum chloride with sodium hydroxide. Generally, the PAC can be prepared by the addition of two moles of a base to one mole of aluminum chloride. The species is soluble and stable when dissolved and stored under acidic conditions if the pH is less than 5. The species in solution is believed to be of the formula $Al_{13}O_4(OH)_{24}(H_2O)_{12}$ with 7 positive electrical charges per unit according to the following published literature: [(a) Book: *The Hydrolysis of Cations*, C. F. Baes & R. E. Mesmer (authors), John Wiley & Sons, NY 1976. (b) Inorganic metal polymers: preparation and characterization, in *Journal of the American Waterworks Association*, vol. 87, pp 136–146 (1995) authors K. A. Gray, C. Yao and C. R. O'Melia]. Examples of water soluble metal salts that can be used in place of PAC include aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate and the like, are generally in the range amount of about 0.05 pph to about 0.5 pph.

Examples of the first coagulant are polyaluminum chloride, or the corresponding bromide, fluoride, or iodide, and examples of the second coagulant are dialkyl benzenealkyl ammonium chloride, lauryl trimethyl ammonium chloride, alkylbenzyl methyl ammonium chloride, alkyl benzyl dimethyl ammonium bromide, wherein alky is, for example, preferably from about 5 to about 20 carbon atoms, with the amounts of each being from about 0.03 pph to about 1.0 pph by weight of toner aggregate and preferably in the range of about 0.05 to about 0.5 pph by weight of toner aggregates.

The toner may also include known charge additives in effective suitable amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, the disclosures of which are totally incorporated herein by reference, negative charge enhancing additives like aluminum complexes, other known charge additives, and the like.

Surface additives that can be added to the toner compositions after washing or drying include, for example, metal salts, metal salts of fatty acids, colloidal silicas, metal oxides, strontium titanates, mixtures thereof, and the like, which additives are each usually present in an amount of from about 0.1 to about 2 weight percent, reference for example U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa. The coated silicas of copending applications U.S. Ser. Nos. 09/132,188 and 09/132,623, the disclosures of which are totally incorporated herein by reference, in amounts of from about 0.1 to about 2 percent, which additives can be added during the aggregation or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration. The carrier particles can also be comprised of a core with a polymer coating thereover, such as polymethylmethacrylate (PMMA) having dispersed therein a conductive component like conductive carbon black. Carrier coatings include silicone resins, fluoropolymers, mixtures of resins not in close proximity in the triboelectric series, thermosetting resins, and other known components.

Imaging methods are also envisioned with the toners of the present invention, reference for example a number of the patents mentioned herein, and U.S. Pat. Nos. 4,265,990; 4,858,884; 4,584,253 and 4,563,408, the disclosures of which are totally incorporated herein by reference.

The following Examples and Comparative Examples are provided.

Latex Preparation: LATEX A ($M_w$ 30 k, $T_g$ 55 C)

A latex emulsion comprised of polymer particles generated from the emulsion polymerization of styrene, butyl acrylate and acrylic acid was prepared as follows. A mixture of 2,255 grams of styrene, 495 grams of butyl acrylate, 55.0 grams of acrylic acid, 27.5 grams of carbon tetrabromide and 96.25 grams of dodecanethiol was added to an oxygen free aqueous solution prepared from 27.5 grams of ammonium persulfate in 1,000 milliliters of water and 2,500 milliliters of an aqueous solution containing 62 grams of anionic surfactant, NEOGEN R™ which is Sodium dodecylbenzene sulfonate (described as NEOGEN R™ throughout all examples) and 33 grams of poly(ethylene glycol)-α-methyl ether-ω-methyl p-tert-octylphenyl phosphate hydrolyzable nonionic surfactant. The resulting mixture was emulsified at room temperature, about 25° C., under a nitrogen atmosphere for 30 minutes. Subsequently, the mixture was stirred and heated to 70° C. (Centigrade throughout) at a rate of 1° C., per minute, and retained at this temperature for 6 hours. The resulting latex polymer of poly(styrene-co butyl acrylate-co-acrylic acid) possessed an $M_w$ of 29,300, and an $M_n$ of 7,212, as measured by Gel Permeation Chromatography, and a mid-point Tg of 55.6° C. (Centigrade) as measured using Differential Scanning Calorimetry.

Latex Preparation: LATEX B ($M_w$ 30 k, $T_g$ 65 C)

A latex emulsion comprised of polymer particles generated from the emulsion polymerization of styrene, butyl acrylate and acrylic acid was prepared as follows. A mixture of 2,255 grams of styrene, 495 grams of butyl acrylate, 55.0 grams of acrylic acid, 20.6 grams of carbon tetrabromide and 48.2 grams of dodecanethiol was added to an oxygen free aqueous solution prepared from 27.5 grams of ammonium persulfate in 1,000 milliliters of water and 2,500 milliliters of an aqueous solution containing 62 grams of anionic surfactant, NEOGEN R™ which is Sodium dodecylbenzene sulfonate and 33 grams of ANTAROX™ CA897 which is polyoxyethylene octylphenyl ether containing 40 ethylene glycol units, identified as NEOGEN R™ and ANTAROX CA 897. The resulting mixture was emulsified at room temperature of about 25° C. under a nitrogen atmosphere for 30 minutes. Subsequently, the mixture was stirred and heated to 70° C. (Centigrade throughout) at a rate of 1° C. per minute, and retained at this temperature for 6 hours. The resulting latex polymer possessed an $M_w$ of 28,500, an $M_n$ of 8,900, as measured by Gel Permeation Chromatography, and a mid-point Tg of 64.9° C. measured by differential scanning calorimetry.

Latex Preparation LATEX C ($M_w$ 30 k, $T_g$ 55 C)

A latex emulsion comprised of polymer particles generated from the emulsion polymerization of styrene, butyl acrylate and acrylic acid was prepared as follows. A mixture of 2,255 grams of styrene, 495 grams of butyl acrylate, 55.0 grams of acrylic acid, 27.5 grams of carbon tetrabromide and 96.25 grams of dodecanethiol was added to an aqueous solution prepared from 27.5 grams of ammonium persulfate in 1,000 milliliters of water and 2,500 milliliters of an aqueous solution containing 62 grams of anionic surfactant, NEOGEN R™ and 33 grams of ANTAROX™ CA897. The resulting mixture was emulsified at room temperature of about 25° C. under a nitrogen atmosphere for 30 minutes. Subsequently, the mixture was stirred and heated to 70° C. (Centigrade throughout) at a rate of 1° C. per minute, and retained at this temperature for 6 hours. The resulting latex polymer possessed an $M_w$ of 31,500, an $M_n$ of 6,900, as measured by Gel Permeation Chromatography, and a mid-point Tg of 54.9° C. measured by differential scanning calorimetry.

Latex Preparation: LATEX D ($M_w$ 30 k, $T_g$ 55 C not under Nitrogen)

A latex emulsion comprised of polymer particles generated from the emulsion polymerization of styrene, butyl acrylate and acrylic acid was prepared as follows. A mixture of 2,255 grams of styrene, 495 grams of butyl acrylate, 55.0 grams of acrylic acid, 27.5 grams of carbon tetrabromide and 122.25 grams of dodecanethiol was added to an aqueous solution prepared from 27.5 grams of ammonium persulfate in 1,000 milliliters of water and 2,500 milliliters of an aqueous solution containing 62 grams of anionic surfactant, NEOGEN R™ and 33 grams of ANTAROX™ CA897. The resulting mixture was emulsified at room temperature of about 25° C. Subsequently, the mixture was stirred and heated to 70° C. (Centigrade throughout) at a rate of 1° C. per minute, and retained at this temperature for 6 hours. The resulting latex polymer possessed a $M_w$ of 27,500, an $M_n$ of 6,900, as measured by Gel Permeation Chromatography, and a mid-point Tg of 54.9° C. measured by differential scanning calorimetry.

Latex Preparation: LATEX E ($M_w$ 30 k, $T_g$ 55 C

A latex emulsion comprised of polymer particles generated from the emulsion polymerization of styrene, butyl acrylate and acrylic acid was prepared as follows. A mixture of 2,115 grams of styrene, 687 grams of butyl acrylate, 165.0 grams of beta-carboxy ethyl acetate and 75.25 grams of dodecanethiol was added to an aqueous solution prepared from 27.5 grams of ammonium persulfate in 1,000 milliliters of water and 2,500 milliliters of an aqueous solution containing 62 grams of anionic surfactant, NEOGEN R™ and 33 grams of ANTAROX™ CA897. The resulting mixture was emulsified at room temperature of about 25° C. under a nitrogen atmosphere for 30 minutes. Subsequently, the mixture was stirred and heated to 70° C. (Centigrade throughout) at a rate of 1° C. per minute, and retained at this temperature for 6 hours. The resulting latex polymer possessed an $M_w$ of 32,500, an $M_n$ of 5,900, as measured by Gel Permeation Chromatography, and a mid-point Tg of 54.9° C. measured by differential scanning calorimetry.

Latex Preparation: LATEX F ($M_w$ 33 k, $T_g$ 55 C)

A latex emulsion comprised of polymer particles generated from the emulsion polymerization of styrene, butyl acrylate and acrylic acid was prepared as follows. A mixture of 2,255 grams of styrene, 495 grams of butyl acrylate, 165.0 grams of acrylic acid, 27.5 grams of carbon tetrabromide and 84.25 grams of dodecanethiol was added to an aqueous solution prepared from 27.5 grams of ammonium persulfate in 1,000 milliliters of water and 2,500 milliliters of an aqueous solution containing 62 grams of anionic surfactant, NEOGEN R™ and 33 grams of ANTAROX™ CA897. The resulting mixture was emulsified at room temperature of about 25° C. under a nitrogen atmosphere for 30 minutes. Subsequently, the mixture was stirred and heated to 70° C. (Centigrade throughout) at a rate of 1° C. per minute, and retained at this temperature for 6 hours. The resulting latex polymer possessed an $M_w$ of 32,500, an $M_w$ of 6,900, as measured by Gel Permeation Chromatography, and a mid-point Tg of 54.9° C. measured by differential scanning calorimetry.

Latex Preparation: LATEX G ($M_w$ 33 k, $T_g$ 58 C)

A latex emulsion comprised of polymer particles generated from the emulsion polymerization of styrene, butyl acrylate and acrylic acid was prepared as follows. A mixture of 2,200 grams of styrene, 1,238 grams of butyl acrylate, 55.0 grams of acrylic acid, 27.5 grams of carbon tetrabromide and 65.75 grams of dodecanethiol was added to an aqueous solution prepared from 27.5 grams of ammonium persulfate in 1,000 milliliters of water and 2,500 milliliters of an aqueous solution containing 62 grams of anionic surfactant, NEOGEN RK™ and 33 grams of ANTAROX™ CA897. The resulting mixture was emulsified at room temperature of about 25° C. under a nitrogen atmosphere for 30 minutes. Subsequently, the mixture was stirred and heated to 70° C. (Centigrade throughout) at a rate of 1° C. per minute, and retained at this temperature for 6 hours. The resulting latex polymer possessed an $M_w$ of 32,500, an $M_n$ of 6,900, as measured by Gel Permeation Chromatography, and a mid-point Tg of 58.9° C. measured by differential scanning calorimetry.

TONER FABRICATION

EXAMPLE I

Aggregation of Cyan Toner:

390.0 Grams of the above prepared latex emulsion A and 197 grams of an aqueous cyan pigment dispersion containing 7.6 grams of cyan pigment 15.3 having a solids loading of 53.4 percent, were simultaneously added to 600 milliliters of water with high shear stirring by means of a polytron. To this mixture was added a 7.2 grams (grams) of polyaluminum chloride (PAC) solution containing 1.2 grams of 10 percent solids and 6.0 grams of 0.2 molar nitric acid, over a period of 1 minute, followed by the addition of 11.3 grams of cationic surfactant solution containing 1.3 grams of the coagulant SANIZOL B™ (60 percent active ingredients) and 10 grams of deionized water and blended at speed of 5,000 rpm for a period of 2 minutes. The resulting mixture was transferred to a 2 liter reaction vessel and heated at a temperature of 50° C. for 100 minutes hours resutling in aggregates of a size of 5.8 microns and a GSD of 1.19. The pH of the mixture resulting was then adjusted from 2.0 to 5.9 with aqueous base solution of 4 percent sodium hydroxide and allowed to stir for an additional 15 minutes. Subsequently, the resulting mixture was heated to 85° C. and retained there for a period of 4 hours before cooling down to room temperature, about 25° C. The resulting toner slurry pH was then further adjusted to 11.0 with a base solution of 6.8 percent of potassium hydroxide and stirred for 1 hour followed by filtration and reslurring of the wet cake resulting in 1 liter of water. The process of adjusting the pH was accomplished two more times followed by 2 water washings. This washing procedure is referred to as 2 pH, and 2 DIW. The final toner product, after drying in a freeze dryer was comprised of 96.25 percent of the polymer of latex A and 3.75 percent of pigment with a toner particle size of 6.1 microns in volume average diameter and with a particle size distribution of 1.21 both as measured on a Coulter Counter. The morphology was shown to be of a potato shape by scanning electron microscopy. The toner tribo charge as determined by the Faraday Cage method throughout was −32.2 and −14.9 microcoulombs per gram at 20 and 80 percent relative humidity, respectively, measured on a carrier with a core of a ferrite (copper, zinc containing ferrite throughout the Examples obtained from Steward Chemicals), about 90 microns in diameter, with a coating of polymethylmethacrylate and carbon black, about 20 weight percent dispersed therein.

EXAMPLE II

Aggregation of Magenta R: 81.3 ) Toner:

390.0 Grams of the latex emulsion as prepared in Latex example A above and 200 grams of an aqueous magenta pigment dispersion containing 40 grams of magenta pigment R 81.3 having a solids loading of 21 percent, were simultaneously added to 600 milliliters of water with high shear stirring by means of a polytron. To this mixture was added a 7.2 grams of polyaluminum chloride (PAC) solution containing 1.2 grams of 10 percent solids and 6.0 grams of 0.2 molar nitric acid, over a period of 1 minute, followed by the addition of 11.3 grams of the coagulant cationic surfactant solution containing 1.3 grams of SANIZOL B™ (60 percent active ingredients) and 10 grams of deionized water and blended at speed of 5,000 rpm for a period of 2 minutes. The mixture was transferred to a 2 liter reaction vessel and heated at a temperature of 50° C. for 45 minutes resulting in aggregates with a size of 5.8 micron and a GSD of 1.19. The pH of the mixture was then adjusted from 2.0 to 5.9 with aqueous base solution of 4 percent sodium hydroxide and allowed to stir for an additional 15 minutes. Subsequently, the resulting mixture was heated to 85° C. and retained there for a period of 90 minutes before cooling down to room temperature, about 25° C. The toner slurry was then washed according to the 2 pH, 2 DIW washing procedure and dried in the freeze dryer. The final toner product was comprised of 95.0 percent of the polymer of latex A and 5.0 percent of pigment with a toner particle size of 6.2 microns in volume average diameter and with a particle size distribution of 1.19 both as measured on a Coulter Counter. The morphology was shown to be of a potato shape by scanning electron microscopy. The toner tribo charge as determined by the Faraday Cage method throughout was −28.3 and −11.9 microcoulombs per gram at 20 and 80 percent relative humidity, respectively, measured on a carrier with a core of a ferrite, about 90 microns in diameter, with a coating of polymethylmethacrylate and carbon black, about 20 weight percent dispersed therein.

EXAMPLE III

Aggregation of Magenta R: 81.3) Toner (Delayed Latex)

310.0 Grams of the latex emulsion as prepared in Latex example A and 200 grams of an aqueous magenta pigment dispersion containing 40 grams of magenta pigment R 81.3 having a solids loading of 21 percent, were simultaneously added to 600 milliliters of water with high shear stirring by means of a polytron. To this mixture were added a 7.2 grams of polyaluminum chloride (PAC) solution containing 1.2 grams of 10 percent solids and 6.0 grams of 0.2 molar nitric acid, over a period of 1 minute, followed by the addition of 11.3 grams of cationic surfactant solution containing 1.3 grams of SANIZOL B™ (60 percent active ingredients) and 10 grams of deionized water and blended at speed of 5,000 rpm for a period of 2 minutes. The mixture was transferred to a 2 liter reaction vessel and heated at a temperature of 50° C. for 30 minutes resulting in aggregates of a size of 5.6 micron and a GSD of 1.19. To this toner aggregates was added 80 grams of latex A followed by stirring for an additional 20 minutes and the particle size was found to be 6.9 and a GSD of 1.20. The pH of the mixture is then adjusted from 2.0 to 5.9 with aqueous base solution of 4 percent sodium hydroxide and allowed to stir for an additional 15 minutes. Subsequently, the resulting mixture was heated to 85° C. and retained there for a period of 90 minutes before cooling down to room temperature, about 25° C. The toner slurry was then washed according to the 2 pH, 2 DIW washing procedure and dried in the freeze dryer. The final toner product was comprised of 95.0 percent of the polymer of latex A and 5.0 percent of pigment with a toner particle size of 6.2 microns in volume average diameter and with a particle size distribution of 1.19 both as measured on a Coulter Counter. The morphology was shown to be of a potato shape by scanning electron microscopy. The toner tribo charge as determined by the Faraday Cage method throughout was −29.9 and −12.9 microcoulombs per gram at 20 and 80 percent relative humidity, respectively, measured on a carrier with a core of a ferrite, about 90 microns in diameter, with a coating of polymethylmethacrylate and carbon black, about 20 weight percent dispersed therein.

EXAMPLE IV

Aggregation of Black (R 330) Toner:

390.0 Grams of the latex emulsion as prepared in Latex example A and 200 grams of an aqueous black pigment dispersion containing 45 grams of REGAL 330™ carbon black, which dispersion had a solids loading of 22 percent, were simultaneously added to 600 milliliters of water with high shear stirring by means of a polytron. To this mixture was added a 7.2 grams of polyaluminum chloride (PAC) solution containing 1.2 grams of 10 percent solids and 6.0 grams of 0.2 molar nitric acid, over a period of 1 minute, followed by the addition of 11.3 grams of cationic surfactant solution containing 1.3 grams of SANIZOL B™ (60 percent active ingredients) and 10 grams of deionized water and blended at speed of 5,000 rpm for a period of 2 minutes. The mixture was transferred to a 2 liter reaction vessel and heated at a temperature of 51° C. for 80 minutes resulting in aggregates of a size of 6.0 micron and a GSD of 1.20. The pH of the mixture is then adjusted from 2.0 to 5.9 with aqueous base solution of 4 percent sodium hydroxide and allowed to stir for an additional 15 minutes. Subsequently, the resulting mixture was heated to 85° C. and retained there for a period of 90 minutes before cooling down to room temperature, about 25° C. The toner slurry was then washed according to the 2 pH, 2 DIW washing procedure and dried in the freeze dryer. The final toner product was comprised of 94.0 percent of the polymer of latex A and 6.0 percent of pigment with a toner particle size of 6.1 microns in volume average diameter and with a particle size distribution of 1.21 both as measured on a Coulter Counter. The morphology was shown to be of a potato shape by scanning electron microscopy. The toner tribo charge as determined by the Faraday Cage method throughout was −29.7 and −16.2 microcoulombs per gram at 20 and 80 percent relative humidity, respectively, measured on a carrier with a core of a ferrite, about 90 microns in diameter, with a coating of polymethylmethacrylate and carbon black, about 20 weight percent dispersed therein.

EXAMPLE V

Aggregation of Black (R 330) Toner (Delayed Latex):

310.0 Grams of the latex emulsion as prepared in Latex example A and 200 grams of an aqueous black pigment dispersion containing 45 grams of carbon black REGAL 330™ having a solids loading of 22 percent, were simultaneously added to 600 milliliters of water with high shear stirring by means of a polytron. To this mixture was added a 7.2 grams of polyaluminum chloride (PAC) solution containing 1.2 grams of 10 percent solids and 6.0 grams of 0.2 molar nitric acid, over a period of 1 minute, followed by the addition of 11.3 grams of cationic surfactant solution containing 1.3 grams of SANIZOL B™ (60 percent active ingredients) and 10 grams of deionized water and blended at speed of 5,000 rpm for a period of 2 minutes. The mixture was transferred to a 2 liter reaction vessel and heated at a temperature of 50° C. for 30 minutes resulting in aggregates of a size of 5.5 micron and a GSD of 1.19. To this toner aggregate was added 80 grams of latex A and followed by stirring for an additional 45 minutes and the particle size was found to be 6.0 and a GSD of 1.20. The pH of the mixture is then adjusted from 2.0 to 5.9 with aqueous base solution of 4 percent sodium hydroxide and allowed to stir for an additional 15 minutes. Subsequently, the resulting mixture was heated to 85° C. and retained there for a period of 90 minutes before cooling down to room temperature, about 25° C. The resulting toner slurry was then washed according to the 2 pH, 2 DIW washing procedure and dried in the freeze dryer. The final toner product was comprised of 94.0 percent of the polymer of latex A 6.0 percent of pigment with a toner particle size of 6.0 microns in volume average diameter and with a particle size distribution of 1.20 both as measured on a Coulter Counter. The morphology was shown to be of a potato shape by scanning electron microscopy. The toner tribo charge as determined by the Faraday Cage method throughout was −34 and −17.4 microcoulombs per gram at 20 and 80 percent relative humidity, respectively, measured on a carrier with a core of a ferrite, about 90 microns in diameter, with a coating of polymethylmethacrylate and carbon black, about 20 weight percent dispersed therein.

EXAMPLE VI

Aggregation of Yellow 180:

310.0 Grams of the latex emulsion as prepared in Latex example A and 200 grams of an aqueous yellow pigment dispersion containing 60 grams of yellow pigment Y 180 having a solids loading of 21.4 percent, were simultaneously added to 600 milliliters of water with high shear stirring by means of a polytron. To this mixture was added a 7.2 grams of Polyaluminum chloride (PAC) solution containing 1.2 grams of 10 percent solids and 6.0 grams of 0.2 molar nitric acid, over a period of 1 minute, followed by the addition of 11.3 grams of cationic surfactant solution containing 1.3 grams of SANIZOL B™ (60 percent active ingredients) and 10 grams of deionized water and blended at speed of 5,000 rpm for a period of 2 minutes. The mixture was transferred to a 2 liter reaction vessel and heated at a temperature of 52° C. for 60 minutes resulting in aggregates of a size of 6.4 micron and a GSD of 1.19. To this toner aggregate was added 80 grams of latex A and followed by stirring for an additional 45 minutes and the particle size was found to be 6.8 and a GSD of 1.20. The pH of the mixture is then adjusted from 2.0 to 5.9 with aqueous base solution of 4 percent sodium hydroxide and allowed to stir for an additional 15 minutes. Subsequently, the resulting mixture was heated to 85° C. and retained there for a period of 180 minutes before cooling down to room temperature, about 25° C. The toner slurry was then washed according to the 2 pH, 2 DIW washing procedure and dried in the freeze dryer. The final toner product was comprised of 92.75 percent of the polymer of latex A 7.5 percent of pigment with a toner particle size of 6.8 microns in volume average diameter and with a particle size distribution of 1.20 both as measured on a Coulter Counter. The morphology was shown to be of a potato shape by scanning electron microscopy. The toner tribo charge as determined by the Faraday Cage method throughout was −31.8 and −13.4 microcoulombs per gram at 20 and 80 percent relative humidity, respectively, measured on a carrier with a core of a ferrite, about 90 microns in diameter, with a coating of polymethylmethacrylate and carbon black, about 20 weight percent dispersed therein.

EXAMPLE VII

Aggregation of Process Violet (PV 23):

310.0 Grams of the latex emulsion as prepared in Latex example A and 200 grams of an aqueous violet pigment dispersion containing 12 grams of violet pigment PV 23 having a solids loading of 43.8 percent, were simultaneously added to 600 milliliters of water with high shear stirring by means of a polytron. To this mixture was added a 7.2 grams of polyaluminum chloride (PAC) solution containing 1.2 grams of 10 percent solids and 6.0 grams of 0.2 molar nitric acid, over a period of 1 minute, followed by the addition of 11.3 grams of cationic surfactant solution containing 1.3 grams of SANIZOL B™ (60 percent active ingredients) and 10 grams of deionized water and blended at speed of 5,000 rpm for a period of 2 minutes. The mixture was transferred to a 2 liter reaction vessel and heated at a temperature of 50° C. for 30 minutes resulting in aggregates of a size of 6.1 microns and a GSD of 1.19. To the toner aggregates was added 80 grams of latex A and followed by stirring for an additional 30 minutes and the particle size was found to be 6.1 and a GSD of 1.19. The pH of the mixture is then adjusted from 2.0 to 5.9 with aqueous base solution of 4 percent sodium hydroxide and allowed to stir for an additional 15 minutes. Subsequently, the resulting mixture was heated to 85° C. and retained there for a period of 90 minutes before cooling down to room temperature, about 25° C. The toner slurry was then washed according to the 2 pH, 2 DIW washing procedure and dried in the freeze dryer. The final toner product was comprised of 96.6 percent of the polymer of latex A 3.4 percent of pigment with a toner particle size of 6.4 microns in volume average diameter and with a particle size distribution of 1.20 both as measured on a Coulter Counter. The morphology was shown to be of a potato shape by scanning electron microscopy. The toner tribo charge as determined by the Faraday Cage method throughout was −34 and −12.6 microcoulombs per gram at 20 and 80 percent relative humidity, respectively, measured on a carrier with a core of a ferrite, about 90 microns in diameter, with a coating of polymethylmethacrylate and carbon black, about 20 weight percent dispersed therein

EXAMPLE VIII

Aggregation of Cyan Toner:

390.0 Grams of the latex emulsion as prepared in Latex example B and 197 grams of an aqueous cyan pigment dispersion containing 7.6 grams of cyan pigment 15.3 having a solids loading of 53.4 percent, were simultaneously added to 600 milliliters of water with high shear stirring by means of a polytron. To this mixture was added a 7.2 grams of polyaluminum chloride (PAC) solution containing 1.2 grams of 10 percent solids and 6.0 grams of 0.2 molar nitric acid, over a period of 1 minute, followed by the addition of 11.3 grams of cationic surfactant solution containing 1.3 grams of SANIZOL B™ (60 percent active ingredients) and 10 grams of deionized water and blended at speed of 5,000 rpm for a period of 2 minutes. The mixture was transferred to a 2 liter reaction vessel and heated at a temperature of 60° C. for 140 minutes hours resulting in aggregates of a size of 6.2 micron and a GSD of 1.19. The pH of the mixture is then adjusted from 2.0 to 5.9 with aqueous base solution of 4 percent sodium hydroxide and allowed to stir for an additional 15 minutes. Subsequently, the resulting mixture was heated to 85° C. and retained there 25 for a period of 2 hours before cooling down to room temperature, about 25° C. The toner slurry was then washed according to the 2 pH, 2 DIW washing procedure and dried in the freeze dryer. The final toner product was comprised of 96.25 percent of the polymer of latex B, 3.75 percent of pigment with a toner particle size of 6.4 microns in volume average diameter and with a particle size distribution of 1.20 both as measured on a Coulter Counter. The morphology was shown to be of a potato shape by scanning electron microscopy. The toner tribo charge as determined by the Faraday Cage method throughout was −35.9 and −15.2 microcoulombs per gram at 20 and 80 percent relative humidity, respectively, measured on a carrier with a core of a ferrite, about 90 microns in diameter, with a coating of polymethylmethacrylate and carbon black, about 20 weight percent dispersed therein.

EXAMPLE IX

Aggregation of Cyan Toner:

390.0 Grams of the latex emulsion as prepared in Latex example C and 197 grams of an aqueous cyan pigment dispersion containing 7.6 grams of cyan pigment 15.3 having a solids loading of 53.4 percent, were simultaneously added to 600 milliliters of water with high shear stirring by means of a polytron. To this mixture was added a 7.2 grams of polyaluminum chloride (PAC) solution containing 1.2 grams of 10 percent solids and 6.0 grams of 0.2 molar nitric acid, over a period of 1 minute, followed by the addition of 11.3 grams of cationic surfactant solution containing 1.3 grams of SANIZOL B™ (60 percent active ingredients) and 10 grams of deionized water and blended at speed of 5,000 rpm for a period of 2 minutes. The mixture was transferred to a 2 liter reaction vessel and heated at a temperature of 47° C. for 135 minutes hours resulting in aggregates of a size of 5.5 microns and a GSD of 1.17. The pH of the mixture is then adjusted from 2.0 to 5.9 with aqueous base solution of 4 percent sodium hydroxide and allowed to stir for an additional 15 minutes. Subsequently, the resulting mixture was heated to 85° C. and retained there for a period of 2 hours before cooling down to room temperature, about 25° C. The toner slurry was then washed according to the 2 pH, 2 DIW washing procedure and dried in the freeze dryer. The final toner product was comprised of 96.25 percent of the polymer of latex C, 3.75 percent of pigment with a toner particle size of 6.0 microns in volume average diameter and with a particle size distribution of 1.18 both as measured on a Coulter Counter. The morphology was shown to be of a potato shape by scanning electron microscopy. The toner tribo charge as determined by the Faraday Cage method throughout was −38.8 and −13.6 microcoulombs per gram at 20 and 80 percent relative humidity, respectively, measured on a carrier with a core of a ferrite, about 90 microns in diameter, with a coating of polymethylmethacrylate and carbon black, about 20 weight percent dispersed therein.

EXAMPLE X

Aggregation of Cyan Toner:

390.0 Grams of the latex emulsion as prepared in Latex example D and 197 grams of an aqueous cyan pigment dispersion containing 7.6 grams of cyan pigment 15.3 having a solids loading of 53.4 percent, were simultaneously added to 600 milliliters of water with high shear stirring by means of a polytron. To this mixture were added 7.2 grams of polyaluminum chloride (PAC) solution containing 1.2 grams of 10 percent solids and 6.0 grams of 0.2 molar nitric acid, over a period of 1 minute, followed by the addition of 11.3 grams of cationic surfactant solution containing 1.3 grams of SANIZOL B™ (60 percent active ingredients) and 10 grams of deionized water and blended at speed of 5,000 rpm for a period of 2 minutes. The mixture was transferred to a 2 liter reaction vessel and heated at a temperature of 52° C. for 135 minutes hours resulting in toner aggregates of a size of 6.1 microns and a GSD of 1.19. The pH of the mixture is then adjusted from 2.0 to 5.9 with aqueous base solution of 4 percent sodium hydroxide and allowed to stir for an additional 15 minutes. Subsequently, the resulting mixture was heated to 85° C. and retained there for a period of 2 hours before cooling down to room temperature, about 25° C. The toner slurry was then washed according to the 2 pH, 2 DIW washing procedure and dried in the freeze dryer. The final toner product was comprised of 96.25 percent of the polymer of latex D 3.75 percent of pigment with a toner particle size of 6.3 microns in volume average diameter and with a particle size distribution of 1.19 both as measured on a Coulter Counter. The morphology was shown to be of a potato shape by scanning electron microscopy. The toner tribo charge as determined by the Faraday Cage method throughout was −34.8 and −13.7 microcoulombs per gram at 20 and 80 percent relative humidity, respectively, measured on a carrier with a core of a ferrite, about 90 microns in diameter, with a coating of polymethylmethacrylate and carbon black, about 20 weight percent dispersed therein.

EXAMPLE XI

Aggregation of Cyan Toner:

390.0 Grams of the latex emulsion as prepared in Latex example E and 197 grams of an aqueous cyan pigment dispersion containing 7.6 grams of cyan pigment 15.3 having a solids loading of 53.4 percent, were simultaneously added to 600 milliliters of water with high shear stirring by means of a polytron. To this mixture were added 7.2 grams of polyaluminum chloride (PAC) solution containing 1.2 grams of 10 percent solids and 6.0 grams of 0.2 molar nitric acid, over a period of 1 minute, followed by the addition of 11.3 grams of cationic surfactant solution containing 1.3 grams of SANIZOL B™ (60 percent active ingredients) and 10 grams of deionized water and blended at speed of 5,000 rpm for a period of 2 minutes. The mixture was transferred to a 2 liter reaction vessel and heated at a temperature of 43° C. for 30 minutes hours resulting in aggregates of a size of 6.0 micron and a GSD of 1.23. The pH of the mixture is then adjusted from 2.0 to 5.9 with aqueous base solution of 4 percent sodium hydroxide and allowed to stir for an additional 15 minutes. Subsequently, the resulting mixture was heated to 85° C. and retained there for a period of 0.5 hour before cooling down to room temperature, about 25° C. The toner slurry was then washed according to the 2 pH, 2 DIW washing procedure and dried in the freeze dryer. The final toner product was comprised of 96.25 percent of the polymer of latex E, 3.75 percent of pigment with a toner particle size of 6.5 microns in volume average diameter and with a particle size distribution of 1.22 both as measured on a Coulter Counter. The morphology was shown to be of a potato shape by scanning electron microscopy. The toner tribo charge as determined by the Faraday Cage method throughout was −43.2 and −11.5 microcoulombs per gram at 20 and 80 percent relative humidity, respectively, measured on a carrier with a core of a ferrite, about 90 microns in diameter, with a coating of polymethylmethacrylate and carbon black, about 20 weight percent dispersed therein.

EXAMPLE XII

Aggregation of Cyan Toner:

390.0 Grams of the latex emulsion as prepared in Latex example F and 197 grams of an aqueous cyan pigment dispersion containing 7.6 grams of cyan pigment 15.3 having a solids loading of 53.4 percent, were simultaneously added to 600 milliliters of water with high shear stirring by means of a polytron. To this mixture was added a 7.2 grams of polyaluminum chloride (PAC) solution containing 1.2 grams of 10 percent solids and 6.0 grams of 0.2 molar nitric acid, over a period of 1 minute, followed by the addition of 11.3 grams of cationic surfactant solution containing 1.3 grams of SANIZOL B™ (60 percent active ingredients) and 10 grams of deionized water and blended at speed of 5,000 rpm for a period of 2 minutes. The mixture was transferred to a 2 liter reaction vessel and heated at a temperature of 47° C. for 45 minutes hours resulting in aggregates of a size of 6.1 microns and a GSD of 1.20. The pH of the mixture is then adjusted from 2.0 to 5.9 with aqueous base solution of 4 percent sodium hydroxide and allowed to stir for an additional 15 minutes. Subsequently, the resulting mixture was heated to 85° C. and retained there for a period of 10 minutes before cooling down to room temperature, about 25° C. The toner slurry was then washed according to the 2 pH, 2 DIW washing procedure and dried in the freeze dryer. The final toner product was comprised of 96.25 percent of the polymer of latex F, 3.75 percent of pigment with a toner particle size of 6.5 microns in volume average diameter and with a particle size distribution of 1.20 both as measured on a Coulter Counter. The morphology was shown to be of a spherical shape by scanning electron microscopy. The toner tribo charge as determined by the Faraday Cage method throughout was −29.4 and −10 microcoulombs per gram at 20 and 80 percent relative humidity, respectively, measured on a carrier with a core of a ferrite, about 90 microns in diameter, with a coating of polymethylmethacrylate and carbon black, about 20 weight percent dispersed therein.

EXAMPLE XIII

Aggregation of Cyan Toner:

390.0 Grams of the latex emulsion as prepared in Latex example G and 197 grams of an aqueous cyan pigment dispersion containing 7.6 grams of cyan pigment 15.3 having a solids loading of 53.4 percent, were simultaneously added to 600 milliliters of water with high shear stirring by means of a polytron. To this mixture were added 7.2 grams of polyaluminum chloride (PAC) solution containing 1.2 grams of 10 percent solids and 6.0 grams of 0.2 molar nitric acid, over a period of 1 minute, followed by the addition of 11.3 grams of cationic surfactant solution containing 1.3 grams of SANIZOL B™ (60 percent active ingredients) and 10 grams of deionized water and blended at speed of 5,000 rpm for a period of 2 minutes. The mixture was transferred to a 2 liter reaction vessel and heated at a temperature of 54° C. for 45 minutes hours resulting in aggregates of a size of 5.3 micron and a GSD of 1.20. The pH of the mixture is then adjusted from 2.0 to 5.9 with aqueous base solution of 4 percent sodium hydroxide and allowed to stir for an additional 15 minutes. Subsequently, the resulting mixture was heated to 90° C. and retained there for a period of 30 minutes before cooling down to room temperature, about 25° C. The toner slurry was then washed according to the 2 pH, 2 DIW washing procedure and dried in the freeze dryer. The final toner product was comprised of 96.25 percent of the polymer of latex G, 3.75 percent of pigment with a toner particle size of 5.4 microns in volume average diameter and with a particle size distribution of 1.22 both as measured on a Coulter Counter. The morphology was shown to be of a spherical shape by scanning electron microscopy. The toner tribo charge as determined by the Faraday Cage method throughout was −31 and −10 microcoulombs per gram at 20 and 80 percent relative humidity, respectively, measured on a carrier with a core of a ferrite, about 90 microns in diameter, with a coating of polymethylmethacrylate and carbon black, about 20 weight percent dispersed therein.

EXAMPLE XIV

Aggregation of Black (R 330) Toner (Delayed Latex)

310.0 Grams of the latex emulsion as prepared in Latex example A and 200 grams of an aqueous black pigment dispersion containing 45 grams of carbon black REGAL 330™ having a solids loading of 22 percent, were simultaneously added to 600 milliliters of water with high shear stirring by means of a polytron. To this mixture were added 7.2 grams of polyaluminum chloride (PAC) solution containing 1.2 grams of 10 percent solids and 6.0 grams of 0.2 molar nitric acid, over a period of 1 minute, followed by the addition of 11.3 grams of cationic surfactant solution containing 1.3 grams of SANIZOL B™ (60 percent active ingredients) and 10 grams of deionized water and blended at speed of 5,000 rpm for a period of 2 minutes. The mixture was transferred to a 2 liter reaction vessel and heated at a temperature of 50° C. for 40 minutes resulting in aggregates of a size of 5.6 microns and a GSD of 1.20. To this toner aggregate was added 80 grams of latex A and stirred for an additional 30 minutes and the particle size was found to be 6.0 and a GSD of 1.19. The pH of the mixture is then adjusted from 2.0 to 5.9 with aqueous base solution of 4 percent sodium hydroxide and allowed to stir for an additional 15 minutes. Subsequently, the resulting mixture was heated to 85° C. and retained there for a period of 90 minutes before cooling down to room temperature, about 25° C.

The toner slurry pH was then further adjusted to 11.0 with a base solution of 6.8 percent potassium hydroxide and stirred for 1 hour, followed by filtration. A sample of the wet cake was remove and washed with water, followed by drying the cake and labeled as 1 wash. The wet cake was reslurried and its pH readjusted to 11.0 with potassium hydroxide and stirred for 1 hour followed by filtration, and again a sample of the wet cake was removed and washed with water, dried and labeled as wash #2. The procedure of reslurring, adjusting the pH, washing and drying was repeated one more time and sample labeled as wash #4. The final toner product was comprised of 96.25 percent of the polymer of latex A and 3.75 percent of pigment with a toner particle size of 6.2 microns in volume average diameter and with a particle size distribution of 1.20 both as measured on a Coulter Counter. The morphology was shown to be of a potato shape by scanning electron microscopy. The toner tribo charge as determined by the Faraday Cage method was −32.2 and −15.4, microcoulombs per gram at 20 and 80 percent relative humidity, for sample wash #1, −33.1 and −16.7 microcoulombs per gram for sample wash #2 and −33.7 and −15.4 microcoulombs per gram for sample wash #4 as measured on a carrier with a core of a ferrite, about 90 microns in diameter, with a coating of polymethylmethacrylate and carbon black, about 20 weight percent dispersed therein.

EXAMPLE XV

Aggregation of Black (R330):

A black toner prepared by the process of Example V and washed by the process of Example XIV resulted in the following triboelectrical properties. The toner tribo charge as determined by the Faraday Cage method was −33.1 and −15.6, microcoulombs per gram at 20 and 80 percent relative humidity, for sample wash #1, −32 and −16.7 microcoulombs per gram for sample wash #2 and −34.2 and −17.4 microcoulombs per gram for sample wash #4 as measured on a carrier with a core of a ferrite, about 90 microns in diameter, with a coating of polymethylmethacrylate and carbon black, about 20 weight percent dispersed therein.

EXAMPLE XVI

Aggregation of Magenta (R.81.3):

A magenta toner was prepared as outlined in Example III and washed as that described in Example XIV resulted in the following tribo electrical properties. The toner tribo charge as determined by the Faraday Cage method was −29.4 and −9.7, microcoulombs per gram at 20 and 80 percent relative humidity, for sample wash #1, −27.5 and −10.9 microcoulombs per gram for sample wash #2 and −29.9 and −12.9 microcoulombs per gram for sample wash #4 as respectively, measured on a carrier with a core of a ferrite, about 90 microns in diameter, with a coating of polymethylmethacrylate and carbon black, about 20 weight percent dispersed therein.

EXAMPLE XVII

Aggregation of Yellow (Y 180):

A yellow toner was prepared as outlined in Example VI and washed as described in Example XIV resulted in the following tribo electrical properties. The toner tribo charge as determined by the Faraday Cage method was −26.8 and −13.5, microcoulombs per gram at 20 and 80 percent relative humidity for sample wash #1, −25.7 and −13.8 microcoulombs per gram for sample wash #2 and −31.8 and −13.4 microcoulombs per gram for sample wash #4 as respectively, measured on a carrier with a core of a ferrite, about 90 microns in diameter, with a coating of polymethylmethacrylate and carbon black, about 20 weight percent dispersed therein.

EXAMPLE XVIII

Aggregation of Cyan Toner (Aluminum Sulfate):

390.0 Grams of the latex emulsion as prepared in latex Example I and 197 grams of an aqueous cyan pigment dispersion containing 7.6 grams of cyan pigment 15.3 having a solids loading of 53.4 percent, were simultaneously added to 600 milliliters of water with high shear stirring by means of a polytron. To this mixture were added 8.0 grams of aluminum sulfate (solution containing 1.0 gram of aluminum sulfate, 1 gram of water and 6.0 grams of 0.2 molar nitric acid, over a period of 1 minute, followed by the addition of 11.3 grams of cationic surfactant solution containing 1.3 grams of SANIZOL B™ (60 percent active ingredients) and 10 grams of deionized water and blended at speed of 5,000 rpm for a period of 2 minutes. The mixture was transferred to a 2 liter reaction vessel and heated at a temperature of 50° C. for 20 minutes hours resulting in aggregates of a size of 5.4 micron and a GSD of 1.20. The pH of the mixture is then adjusted from 2.0 to 5.9 with aqueous base solution of 4 percent sodium hydroxide and allowed to stir for an additional 15 minutes. Subsequently, the resulting mixture was heated to 85° C. and retained there for a period of 1.5 hours before cooling down to room temperature, about 25° C. The toner slurry was then washed according to the 2 pH, 2 DIW washing procedure and dried in the freeze dryer. The final toner product was comprised of 96.25 percent of the polymer of latex G, 3.75 percent of pigment with a toner particle size of 5.5 microns in volume average diameter and with a particle size distribution of 1.22 both as measured on a Coulter Counter. The morphology was shown to be of a spherical shape by scanning electron microscopy. The toner tribo charge as determined by the Faraday Cage method throughout was −39.3 and 20.1 microcoulombs per gram at 20 and 80 percent relative humidity, respectively, measured on a carrier with a core of a ferrite, about 90 microns in diameter, with a coating of polymethylmethacrylate and carbon black, about 20 weight percent dispersed therein.

EXAMPLE XIX

Aggregation of Cyan Toner (Magnesium Sulfate):

390.0 Grams of the latex emulsion as prepared in Latex example A and 197 grams of an aqueous cyan pigment dispersion containing 7.6 grams of cyan pigment 15.3 having a solids loading of 53.4 percent, were simultaneously added to 600 milliliters of water with high shear stirring by means of a polytron. To this mixture were added 16 grams of magnesium sulfate solution containing 3.0 grams of magnesium sulfate, 7.0 grams of water and 6.0 grams of 0.2 molar nitric acid, over a period of 1 minute, followed by the addition of 11.3 grams of cationic surfactant solution containing 1.3 grams of SANIZOL B™ (60 percent active ingredients) and 10 grams of deionized water and blended at speed of 5,000 rpm for a period of 2 minutes. The mixture was transferred to a 2 liter reaction vessel and heated at a temperature of 47° C. for 30 minutes hours resulting in aggregates of a size of 4.6 microns and a GSD of 1.21. The pH of the mixture was then adjusted from 2.0 to 6.0 with aqueous base solution of 4 percent sodium hydroxide and allowed to stir for an additional 15 minutes. Subsequently, the resulting mixture was heated to 85° C. and retained there for a period of 3 hours before cooling down to room temperature, about 25° C. The toner slurry was then washed according to the 2 pH, 2 DIW washing procedure and dried in the freeze dryer. The final toner product was comprised of 96.25 percent of the polymer of latex G, 3.75 percent of pigment with a toner particle size of 5.0 microns in volume average diameter and with a particle size distribution of 1.23 both as measured on a Coulter Counter. The morphology was shown to be of a spherical shape by scanning electron microscopy. The toner tribo charge as determined by the Faraday Cage method throughout was −39.3 and 12.6 microcoulombs per gram at 20 and 80 percent relative humidity, respectively, measured on a carrier with a core of a ferrite, about 90 microns in diameter, with a coating of polymethylmethacrylate and carbon black, about 20 weight percent dispersed therein.

EXAMPLE XX

Aggregation of Cyan Toner (Zinc Sulfate):

390.0 Grams of the latex emulsion as prepared in Latex example A and 197 grams of an aqueous cyan pigment dispersion containing 7.6 grams of cyan pigment 15.3 having a solids loading of 53.4 percent, were simultaneously added to 600 milliliters of water with high shear stirring by means of a polytron. To this mixture were added 9.75 grams of zinc sulfate solution containing 1.7 grams of zinc sulfate, 2.05 grams of water and 6.0 grams of 0.2 molar nitric acid, over a period of 1 minute, followed by the addition of 11.3 grams of cationic surfactant solution containing 1.3 grams of SANIZOL B™ (60 percent active ingredients) and 10 grams of deionized water and blended at speed of 5,000 rpm for a period of 2 minutes. The mixture was transferred to a 2 liter reaction vessel and heated at a temperature of 50° C. for 60 minutes hours resulting in aggregates of a size of 5.4 microns and a GSD of 1.17. The pH of the mixture was then adjusted from 2.0 to 6.2 with aqueous base solution of 4 percent sodium hydroxide and allowed to stir for an additional 15 minutes. Subsequently, the resulting mixture was heated to 90° C. and retained there for a period of 2 hours before cooling down to room temperature, about 25° C. The toner slurry was then washed according to the 2 pH, 2 DIW washing procedure and dried in the freeze dryer. The final toner product was comprised of 96.25 percent of the polymer of latex G, 3.75 percent of pigment with a toner particle size of 6.0 microns in volume average diameter and with a particle size distribution of 1.21 both as measured on a Coulter Counter. The morphology was shown to be of a spherical shape by scanning electron microscopy. The toner tribo charge as determined by the Faraday Cage method throughout was −55.2 and 16.8 microcoulombs per gram at 20 and 80 percent relative humidity, respectively, measured on a carrier with a core of a ferrite, about 90 microns in diameter, with a coating of polymethylmethacrylate and carbon black, about 20 weight percent dispersed therein.

PREPARATION OF TONER CONTAINING WAXES

EXAMPLE XXI

Preparation of Black Toner (7 Percent P 725 Wax):

A black toner was prepared in accordance with Example V and where 35 grams of a dispersion of submicron, 0.5, polyethylene wax particles with (35 weight percent solids) suspended in an aqueous phase containing anionic surfactant was introduced into the latex prior to the blending step. The toner particles were washed with the outlined, 2 pH 11, 2 DIW procedure and dried.

EXAMPLE XXII

Preparation of Black Toner (7 Percent P 725 Wax):

The process of Example XXI was repeated and a similar toner was obtained.

EXAMPLE XXIII

Preparation of Yellow Toner (7 Percent P 725 Wax):

A yellow toner was prepared in accordance with Example V and where 35 grams of a dispersion of submicron, about 0.5, polyethylene wax particles with (35 weight percent solids) suspended in an aqueous phase containing anionic surfactant was introduced into the latex prior to the blending step . The toner was washed with the outlined, 2 pH 11, 2 DIW procedure and dried.

EXAMPLE XXIV

Preparation of Cyan Toner (7 Percent P 725 Wax):

A Cyan toner was prepared in accordance with Example V and where 35 grams of a dispersion of submicron polyethylene wax particles with (35 weight percent solids) suspended in an aqueous phase containing anionic surfactant was introduced into the latex prior to the blending step. The toner was washed with the outlined, 2 pH 11, 2 DIW procedure and dried.

COMPARATIVE EXAMPLE 1

Aggregation of Cyan Toner:

260.0 Grams of the latex emulsion as prepared in Example A and 220.0 grams of an aqueous cyan pigment dispersion containing 7.6 grams of Blue Pigment 15.3 having a solids loading of 54 percent, and 2.0 grams of cationic surfactant SANIZOL B™ were simultaneously added to 400 milliliters of water with high shear stirring by means of a polytron. The resulting mixture was transferred to a 2 liter reaction vessel and heated at a temperature of 50° C. for 75 minutes resulting in aggregates of a size of 5.0 microns and GSD of 1.19, before 50 milliliters of 20 percent aqueous NEOGEN R™ solution were added. Subsequently, the mixture was heated to 95° C. and held there for a period of 3 hours before cooling down to room temperature, filtered, washed with water, and dried in a freeze dryer. The final toner product of 96.25 percent polymer and 3.75 percent Pigment Blue 15.3 evidenced a particle size of 6.4 microns in volume average diameter with a particle size distribution of 1.20 as measured on a Coulter Counter, and was shown to be of potato shape by scanning electron microscopy. The toner exhibited a tribo charge of −42.5 and −12.6 $\mu$C/gram at 20 and 80 percent relative humidity, respectively.

Toner tribo was obtained by mixing in all instances the toner with carrier as indicated herein in Example I.

COMPARATIVE EXAMPLE 2

Magenta Toner:

260.0 Grams of the latex emulsion as prepared in Example A and 220.0 grams of an aqueous magenta pigment dispersion containing 23 grams of Magenta Pigment R81:3 having a solids loading of 21 percent, and 2.2 grams of cationic surfactant SANIZOL B™ were simultaneously added to 400 milliliters of water with high shear stirring by means of a polytron. The resulting mixture was transferred to a 2 liter reaction vessel and heated at a temperature of 50° C. for 50 minutes resulting in aggregates of a size of 6.1 microns and GSD of 1.21, before 60 milliliters of 20 percent aqueous NEOGEN R™ solution were added. Subsequently, the mixture was heated to 95° C. and held there for a period of 3 hours before cooling down to room temperature, filtered, washed using the 2pH, 2 DIW, procedure and dried in a freeze dryer. The final toner product of 95.5 percent polymer and 4.5 percent Pigment Red 81:3 evidenced a particle size of 6.5 microns in volume average diameter with a particle size distribution of 1.23 as measured on a Coulter Counter, and was shown to be of potato shape by scanning electron microscopy. The toner exhibited a tribo charge of −36.2 and −13.4 $\mu$C/gram at 20 and 80 percent relative humidity, respectively.

COMPARATIVE EXAMPLE 3

Yellow Toner:

260.0 Grams of the latex emulsion as prepared in Example A and 220.0 grams of an aqueous yellow pigment dispersion containing 30 grams of Yellow Pigment Y 17 having a solids loading of 31 percent, and 2.1 grams of cationic surfactant SANIZOL B™ were simultaneously added to 400 milliliters of water with high shear stirring by means of a polytron. The resulting mixture was transferred to a 2 liter reaction vessel and heated at a temperature of 50° C. for 90 minutes resulting in aggregates of a size of 6.1 microns and GSD of 1.19, before 70 milliliters of 20 percent aqueous NEOGEN R™ solution were added. Subsequently, the mixture was heated to 95° C. and held there for a period of 3 hours before cooling down to room temperature, filtered, washed using the 2pH, 2 DIW, procedure and dried in a freeze dryer. The final toner product of 90 percent polymer and 10 percent Pigment Yellow 17 evidenced a particle size of 6.3 microns in volume average diameter with a particle size distribution of 1.21 as measured on a Coulter Counter, and was shown to be of potato shape by scanning electron microscopy. The toner exhibited a tribo charge of −43.1 and −14.2 $\mu$C/gram at 20 and 80 percent relative humidity, respectively.

COMPARATIVE EXAMPLE 4

Black Toner:

260 Grams of the latex emulsion as prepared in Example A and 220.0 grams of an aqueous black pigment dispersion containing 31 grams of REGAL 330™ carbon black, having a solids (refers to the colorant dispersion throughout) loading of 21 percent, and 2.1 grams of cationic surfactant SANIZOL B™ were simultaneously added to 400 milliliters of water with high shear stirring by means of a polytron. The resulting mixture was transferred to a 2 liter reaction vessel and heated at a temperature of 50° C. for 75 minutes resulting in aggregates of size of 6.0 microns and GSD of 1.20, before 60 milliliters of 20 percent aqueous NEOGEN R™ solution were added. Subsequently, the mixture was heated to 95° C. and held there for a period of 3 hours before cooling down to room temperature, filtered, washed using the 2 pH, 2 DIW, procedure and dried in a freeze dryer. The final toner product of 94 percent polymer and 6.0 percent Pigment Black R 330 evidenced a particle size of 6.3 microns in volume average diameter with a particle size distribution of 1.21 as measured on a Coulter Counter, and was shown to be of potato shape by scanning electron microscopy. The toner exhibited a tribo charge of −18.4 and −7.6 $\mu$C/gram at 20 and 80 percent relative humidity, respectively.

With the toners prepared as illustrated herein, especially a magenta toner prepared with the use of two coagulants of PAC and the cationic surfactant the toner charge was a negative value, for example about −2 (fc/um), and this charge remained negative and at about −0.18 for periods of from 0 to 150 minutes of shaking on a paint shaker, compared to the same magenta toner prepared with one surfactant, reference Comparative Example 2, wherein the toner tribo was initially negative and then positive after about 45 minutes of paint shaking and wherein the toner tribo decreased to a positive (fc/um) 0.2 after 150 minutes of paint shaking.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for the preparation of toner comprising mixing a colorant, a latex, and two coagulants, followed by aggregation and coalescence and wherein said two coagulants are comprised of a first coagulant of polyaluminum hydroxy halide and a second coagulant of a cationic surfactant.

2. A process in accordance with claim 1 wherein the polyaluminum hydroxy halide is a polyaluminum hydroxy chloride complex.

3. A process in accordance with claim 1 wherein said aggregation is accomplished by heating at a temperature of below about the glass transition temperature of the polymer contained in the latex.

4. A process in accordance with claim 1 wherein said coalescence is accomplished by heating at a temperature of above about the glass transition temperature of the polymer contained in the latex.

5. A process in accordance with claim 4 wherein said coalescence temperature is from about 75 to about 90° C.

6. A process in accordance with claim 4 wherein said coalescence temperature is about 85° C.

7. A process in accordance with claim 3 wherein said aggregation temperature is from about 40 to about 55° C.

8. A process in accordance with claim 1 wherein the latex is an emulsion that contains resin and a surfactant, and wherein the surfactant is of the Formulas (I) or (II), or optionally mixtures thereof (I)

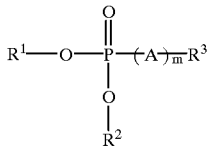

(II)

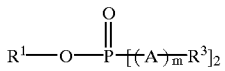

wherein $R^1$ is a hydrophobic aliphatic, or hydrophobic aromatic group; $R^2$ is selected from the group consisting of hydrogen, alkyl, aryl, alkylaryl, and alkylarylalkyl; $R^3$ is hydrogen or alkyl; A is a hydrophilic polymer chain, and m represents the number of A segments.

9. A process in accordance with claim 8 wherein $R^1$ is a hydrophobic moiety of alkyl or aryl; and wherein m is a number of from about 5 to about 60, and there is accomplished a heating below about or equal to about the resin latex glass transition temperature to form aggregates followed by heating above about or equal to about the resin glass transition temperature to coalesce the aggregates.

10. A process in accordance with claim 8 wherein the surfactant is a cleavable surfactant selected from the group consisting of poly(ethylene glycol) methyl p-tert-octylphenyl phosphate, poly(ethylene glycol)-α-methyl ether-ω-methyl p-tert-octylphenyl phosphate, poly(ethylene glycol) methyl decylphenyl phosphate, poly(ethylene glycol)-α-methyl ether-ω-methyl dodecylphenyl phosphate, poly(ethyleneglycol) methyl dodecylphenyl phosphate, bis [poly(ethylene glycol)-α-methyl ether]-ω-p-tert-octylphenyl phosphate, poly(ethylene glycol)-α,ω-methyl p-tert-octylphenyl phosphate, poly(ethylene glycol) ethyl p-tert-octylphenyl phosphate, poly(ethylene glycol)-α-methyl ether-ω-ethyl p-tert-octylphenyl phosphate, poly (ethylene glycol) phenyl p-tert-octylphenyl phosphate, poly (ethylene glycol)-α-methyl ether-ω-phenyl p-tert-octylphenyl phosphate, poly(ethylene glycol) tolyl p-tert-octylphenyl phosphate, poly(ethylene glycol)-α-methyl ether-ω-tolyl p-tert-octylphenyl phosphate, and poly (ethylene oxide-co-propylene oxide) methyl p-tert-octylphenyl phosphate, wherein the polymer chain contains from about 5 to about 50 repeating units or segments.

11. A process in accordance with claim 8 wherein m is a number of from about 10 to about 50.

12. A process in accordance with claim 1 wherein the temperature at which said aggregation is accomplished controls the size of the aggregates, and wherein the final toner size is from about 2 to about 15 microns in volume average diameter.

13. A process in accordance with claim 1 wherein the aggregation temperature is from about 45° C. to about 55° C., and wherein the coalescence or fusion temperature is from about 85° C. to about 95° C.

14. A process in accordance with claim 1 wherein the colorant is a pigment, and wherein said pigment is in the form of dispersion and contains an ionic surfactant.

15. A process in accordance with claim 14 wherein the surfactant utilized in the colorant dispersion is a cationic surfactant, and the ionic surfactant present in the latex mixture is an anionic surfactant; wherein the aggregation is accomplished at a temperature of about 15° C. to about 1° C. below the Tg of the latex resin for a duration of from about 0.5 hour to about 3 hours; and wherein the coalescence or fusion of the components of aggregates for the formation of integral toner particles comprised of colorant and resin additives is accomplished at a temperature of from about 85° C. to about 95° C. for a duration of from about 1 hour to about 5 hours.

16. A process in accordance with claim 1 wherein the latex contains a resin, or polymer selected from the group consisting of poly(styrene-alkyl acrylate), poly(styrene-1,3-diene), poy(styrene-alkyl methacrylate), poly(styrene-alkyl acrylate-acrylc acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid).

17. A process in accordance with claim 1 wherein the latex contains a resin selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly (styrene-butyl acrylate-acrylononitrile-acrylic acid); and wherein said colorant is a pigment.

18. A process in accordance with claim 1 wherein the colorant is carbon black, cyan, yellow, magenta, or mixtures thereof; the toner isolated is from about 2 to about 15 microns in volume average diameter, and the particle size distribution thereof is from about 1.15 to about 1.30 GSD; and wherein there is added to the surface of the formed toner metal salts, metal salts of fatty acids, silicas, metal oxides, or mixtures thereof, each in an amount of from about 0.1 to about 10 weight percent of the obtained toner.

19. A process in accordance with claim 1 which comprises mixing a resin containing latex, an ionic surfactant and colorant; heating the resulting mixture below about, or equal to about the glass transition temperature of the resin; followed by the addition of a base to stabilize the toner aggregates; thereafter heating the resulting aggregates above about, or about equal to the glass transition temperature of the resin; and isolating, washing and drying the toner.

20. A process for the preparation of toner consisting essentially of mixing a colorant, a latex, and two coagulants, followed by aggregation and coalescence, and wherein said two coagulants consist essentially of a first coagulant of polyaluminum hydroxy halide and a second coagulant of a cationic surfactant.

21. A process in accordance with claim 20 wherein the polyaluminum hydroxy halide is a polyaluminum hydroxy chloride complex.

* * * * *